United States Patent [19]

Cunko, Jr.

[11] 4,368,768

[45] Jan. 18, 1983

[54] GOLF CLUB COVER ASSEMBLY

[76] Inventor: Edward F. Cunko, Jr., 99 Vernon St., Belle Vernon, Pa. 15012

[21] Appl. No.: 287,220

[22] Filed: Jul. 27, 1981

[51] Int. Cl.[3] ..... A63B 55/00; A63B 57/00

[52] U.S. Cl. ..... 150/52 G; 150/1.5 R

[58] Field of Search ..... 150/1.5 R, 52 G; 273/32 E, 32 R

[56] References Cited

U.S. PATENT DOCUMENTS

| | | | |
|---|---|---|---|
| 2,014,589 | 9/1935 | Saad | 150/52 G |
| 2,128,546 | 8/1938 | Venmore | 150/1.5 R |
| 2,676,803 | 4/1954 | Damaske | 150/52 G X |
| 3,426,815 | 2/1969 | Ashlin et al. | 150/52 G |
| 3,667,078 | 6/1972 | Distasio | 150/1.5 R X |
| 4,126,166 | 11/1978 | Hohenstein | 150/52 G X |

*Primary Examiner*—William Price
*Assistant Examiner*—Sue A. Weaver
*Attorney, Agent, or Firm*—Thomas H. Murray

[57] ABSTRACT

A golf club cover incorporating a substantially rigid stay which is fastened to the top edge of a golf bag such that the cover will remain in an upright position when a golf club is removed therefrom. The cover is in the form of a pouch having a slit extending along its longitudinal edge to permit a golf club head to be inserted into the pouch through the slit. Closure means, preferably a Velcro fastener, is provided for the slit.

5 Claims, 3 Drawing Figures

GOLF CLUB COVER ASSEMBLY

BACKGROUND OF THE INVENTION

In the game of golf, it is common to provide covers for certain clubs, called "woods" since they have polished wooden heads which can become scratched by contact of the clubs with each other. To avoid such scratches to the wooden heads, it has been common to provide each head with a cover, generally fabricated from a flexible material such as plastic, leather or knitted material.

While most prior art covers perform their functions satisfactory, they have a tendency to become misplaced and lost. To maintain all of the covers together and prevent their being lost, various arrangements have been provided for connecting the covers to straps or a stringer. With an arrangement of this sort, however, the covers dangle about and become tangled and cause the other covers to leave their clubs and become lost. Furthermore, when such covers become wet, it is very difficult to place the covers on their individual club heads.

SUMMARY OF THE INVENTION

In accordance with the present invention, the problems encountered with prior art golf club covers are eliminated by providing covers incorporating rigid stays which can be fastened to the top edge of a golf club bag such that the covers remain in upright positions at all times and cannot become tangled or misplaced.

Specifically, there is provided a golf club cover comprising an elongated pouch formed from flexible sheet material and having a lower open end through which the shank portion of a golf club extends. A pocket is formed in one side of the pouch and extends along the longitudinal length thereof. This pocket receives a substantially rigid stay which has a lower end projecting from the pocket adjacent the lower open end of the pouch. Means are provided for securing the lower end of the stay to the upper portion of a golf bag whereby the pouch will remain in an upright position when a golf club is removed therefrom. A slit extends along the longitudinal edge of each cover through which a golf club head can be inserted or removed sideways. This slit is provided with a fastener, preferably a Velcro fastener; although a zipper or other similar fastener can be employed. The lower end of the rigid stay can be provided with slots through which a belt can extend, this belt encircling the upper portion of a golf bag to secure the stay to the upper periphery of a golf club bag to maintain the stays and the covers in upright positions. Alternatively, the lower ends of the stays can be permanently affixed to the upper edge of a golf club bag or built into a new golf club bag.

In the use of the invention, a wood club can be removed from the cover which will remain in place in an upright position ready to again receive the club. The covers are not affected by factors such as rain; and there is no need to pull them over the woods since the club may be inserted through the aforesaid slit and into the cover in a sideways direction. When the covers are fastened to the upper edge of a golf club bag by means of a belt, they can be removed by simply loosening the belt.

The above and other objects and features of the invention will become apparent from the following detailed description taken in connection with the accompanying drawings which form a part of this specification, and in which.

Figure 1:
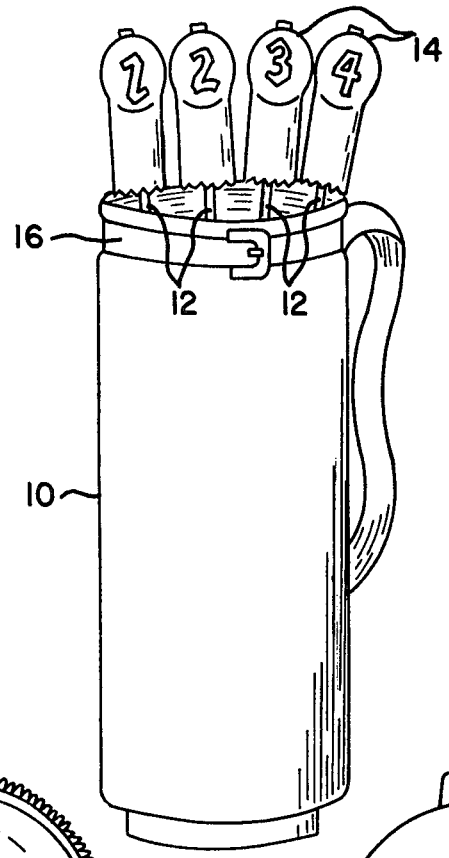
FIG. 1 is a perspective view of a golf club bag having golf club covers of the invention secured thereto.

With reference now to the drawings, and particularly to FIG. 1, a conventional golf club bag 10 is shown having a plurality of woods 12 inserted therein. The upper ends or heads of the clubs are covered by four golf club covers 14 which are fastened to the upper edge of the golf bag 10 by means of an adjustable belt 16 which can be the same or similar to a conventional trouser belt.

Figure 2:
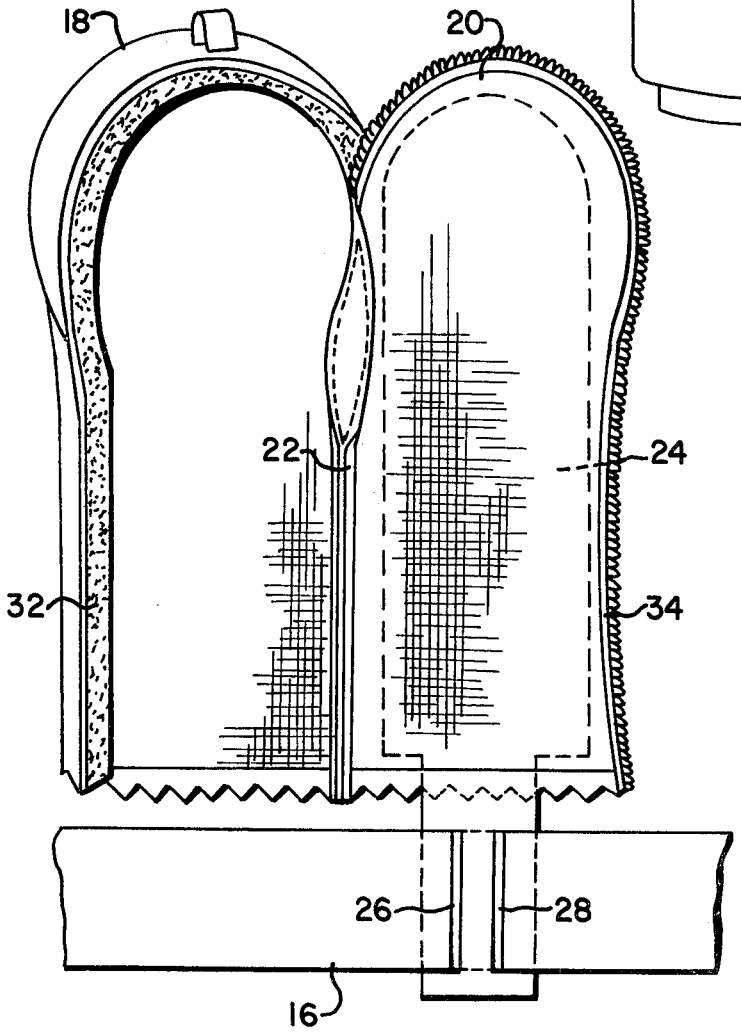
FIG. 2 is an elevational view of the golf club cover of the invention, showing the cover in its open position for receiving a golf club head.
Figure 3:
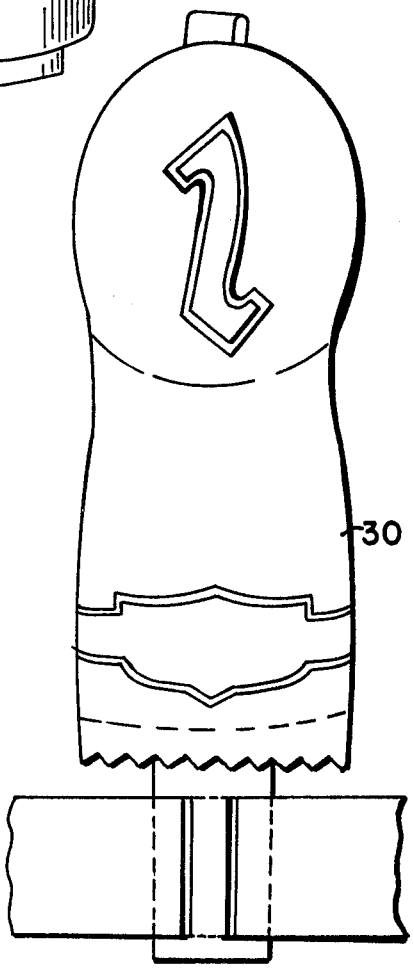
FIG. 3 is an elevational view of the golf club cover of the invention when closed.

The details of the covers 14 are shown in FIGS. 2 and 3. Each comprises a pouch formed from a front half 18 and a rear half 20 hinged along a flexible seam 22. The pouch halves 18 and 20 can be formed from any flexible material such as plastic, cloth or the like. The rear half 20 is formed with a longitudinally-extending slot, formed from two plies of cloth, which receives an upstanding rigid stay 24. The stay 24 is preferably formed from a sheet of substantially rigid or semi-rigid plastic, such as polyethylene, and has a lower end provided with slots 26 and 28 through which the belt 16 extends. Thus, with the belt 16 encircling the upper edge of the golf bag 10 and drawn tightly into place, each of the stays 24 will maintain an upright, essentially vertical position, as will the front and rear pouch halves 18 and 20.

The two halves 18 and 20 form a longitudinal slit along the right edge 30 (FIG. 3) thereof. This slit forms two mating surfaces 32 and 34 having the two halves of a Velcro fastener sewn thereto. Alternatively, the slit can be provided with a zipper or any other similar fastening means.

In the use of the invention, the front half 18, for example, is rotated relative to the back half 20 about the hinge connection 22 and into the position shown in FIG. 2 where the pouch can receive a golf club head inserted sideways or as it descends into the golf club bag. Thereafter, the front half 18 is rotated about the hinge connection 22 into the position shown in FIG. 3 where the Velcro fastener halves hold the two parts in place. To remove the club, it is necessary only to unfasten the Velcro fastener and rotate the front half into the position shown in FIG. 2.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A golf club cover comprising an elongated pouch formed from flexible sheet material and having a lower open end through which the shank portion of a golf club extends, a pocket formed in one side of said pouch and extending along the longitudinal length thereof, a substantially rigid stay extending into said pocket and having a lower end projecting from the pocket adjacent the lower open end of the pouch, and means for securing said lower end of the stay to the upper portion of a golf bag whereby the pouch will remain in an upright position when a golf club is removed therefrom.

2. The golf club cover of claim 1 wherein the elongated pouch is formed from a material selected from the group consisting of plastic, leather and fabric.

3. The golf club cover of claim 1 wherein said rigid stay is provided with slots in the lower end thereof, and including belt means extending through said slots and encircling the upper portion of the golf bag to secure said stay and a golf club cover carried thereby in an upright position.

4. The golf club cover of claim 1 wherein said substantially rigid stay is formed from plastic material.

5. The golf club cover of claim 1 wherein said elongated pouch has a slit extending along the longitudinal length thereof to permit a golf club head to be inserted into the pouch through said slit, and fastening means for closing said slit.

* * * * *